US006749413B2

(12) United States Patent
Fare'

(10) Patent No.: US 6,749,413 B2
(45) Date of Patent: Jun. 15, 2004

(54) MELT-BLOWING HEAD FOR MAKING POLYMERIC MATERIAL FIBRILS

(76) Inventor: Rosaldo Fare', Via Pastrengo 33, 21054 Fagnano Olona (Varese) (IT)

( * ) Notice: Subject to any disclaimer, the term of this patent is extended or adjusted under 35 U.S.C. 154(b) by 95 days.

(21) Appl. No.: 09/977,898

(22) Filed: Oct. 15, 2001

(65) Prior Publication Data

US 2002/0076460 A1 Jun. 20, 2002

(30) Foreign Application Priority Data

Dec. 20, 2000 (IT) ..... MI2000A2765

(51) Int. Cl.[7] ..... D01D 5/00; B29C 47/30

(52) U.S. Cl. ..... 425/72.2; 425/83.1; 425/192 S; 425/382.2; 425/464

(58) Field of Search ..... 425/7, 72.2, 83.1, 425/192 R, 192 S, 382.2, 463, 464

(56) References Cited

U.S. PATENT DOCUMENTS 3,381,336 A * 5/1968 Wells ..... 425/382.2
3,502,763 A * 3/1970 Hartmann ..... 425/72.2
3,561,053 A * 2/1971 Pearson ..... 425/192 R
3,619,859 A * 11/1971 Nelson ..... 425/131.1
3,767,347 A * 10/1973 Landoni ..... 425/378.2
4,387,124 A * 6/1983 Pipkin ..... 427/356
4,550,681 A * 11/1985 Zimmer et al. ..... 118/410
4,945,807 A * 8/1990 Loomans et al. ..... 425/192 R
5,382,312 A * 1/1995 Raterman ..... 156/500
5,487,655 A * 1/1996 Frey et al. ..... 425/72.2
5,720,838 A * 2/1998 Nakata ..... 425/463
5,725,812 A * 3/1998 Choi ..... 425/72.2
5,783,129 A * 7/1998 Shirai et al. ..... 264/136
5,992,453 A * 11/1999 Zimmer ..... 137/561 A
6,210,141 B1 * 4/2001 Allen ..... 425/7
6,422,848 B1 * 7/2002 Allen et al. ..... 425/7

* cited by examiner

*Primary Examiner*—Robert Davis
*Assistant Examiner*—Joseph S Del Sole
(74) *Attorney, Agent, or Firm*—Hedman & Costigan, P.C.

(57) ABSTRACT

A melt-blowing head for making polymeric material fibrils comprises at least a polymeric material inlet channel and melt-blowing die including a plurality of holes for extending fibrils therefrom and a tree-construction channel arrangement for distributing the polymeric material from the inlet channel to each hole of the melt-blowing die.

1 Claim, 5 Drawing Sheets

MELT-BLOWING HEAD FOR MAKING POLYMERIC MATERIAL FIBRILS

BACKGROUND OF THE INVENTION

The present invention relates to a melt-blowing head for supplying in a controlled manner either one or more polymeric materials to a melt-blowing die, either separately from one another or in a mixture thereof.

As known, the so-called melt-blown material, comprise a mass of polymeric material fibrils (for example polyolefine polymers, polyester polymers and copolymers thereof), extruded from a melt-blowing head having an extruding die and by using pressurized hot air jets.

Prior melt-blowing heads are conventionally provided with at least a suitably contoured inner chamber, receiving the mass of the polymeric material fed or supplied through an inlet channel, conveying the polymeric material inside the melt-blowing head.

However, the above mentioned method for supplying the polymeric material, i.e. from the mentioned inlet channel to the holes of the extruding die, does not allow to properly control the distribution of said polymeric material, thereby the polymeric material flow rate is affected by unevennesses, at the melt-blowing die level; moreover, also the holding time of the polymeric material in the melt-blowing head, and its temperature and pressure, and, in general, all the other operating parameters thereof are subjected to unevennesses.

Accordingly, at the outlet of the melt-blowing die, will be present a polymeric material which, for amount, temperature and melt index will be different from region to region, or through the melting die holes, thereby the fibrils generated by the air jet will have a length and a geometric shape which would be very different from region to region or from an assembly of holes to another assembly of holes of the die.

Accordingly, the end product (for example a non-woven fabric) formed by the mentioned fibrils would have a highly dishomogeneous construction, and, accordingly, uncontrollable chemical, physical characteristics.

This problem would be very serious for non woven fabric materials, of very broad diffusion, which have a lower specific gram weight.

SUMMARY OF THE INVENTION

Accordingly, the aim of the present invention is to provide a novel melt-blowing head specifically designed for providing a properly controlled supply of the polymeric material from the melt-blowing head inlet to the outlet of said polymeric material for the melt-blowing die.

Within the scope of the above mentioned aim, a main object of the present invention is to provide a melt-blowing head adapted to properly control the polymeric material flow-rate up to the melt-blowing die, to allow said polymeric material to be held inside the melt-blowing head for a holding time much less than that of prior melting heads, with a less risk of degrading said polymeric material.

The above-mentioned aim and object of the present invention, as well as yet other objects, which will become more apparent hereinafter, are achieved by the melt-blowing head as claimed in the accompanying claims.

Further features of the inventive melt-blowing head are defined in the dependent claims.

With respect to prior melt-blowing heads, the inventive melt-blowing head provide the advantage that it allows to properly control the polymeric material flow and distribution inside said melt-blowing head, thereby reducing to a minimum the holding time of said polymeric material in said melt-blowing head, and also reducing to a minimum possible degrading risks of said polymeric material.

Owing to the inventive melt-blowing head, in particular, the polymeric material will be supplied through a like distance from the inlet hole of the head up to any desired holes of the melt-blowing-die.

Thus, the polymeric material will be provided with the same heat amount and driving energy.

BRIEF DESCRIPTION OF THE DRAWINGS

The above mentioned advantages, as well as further advantages and feature of the present invention, will become more apparent hereinafter from the following detailed disclosure of a preferred embodiment of the melt-blowing head according to the invention which are illustrated, by way of an exemplary but not limitative example, in the figures of the accompanying drawings, where.

DESCRIPTION OF THE PREFERRED EMBODIMENTS

Figure 1:
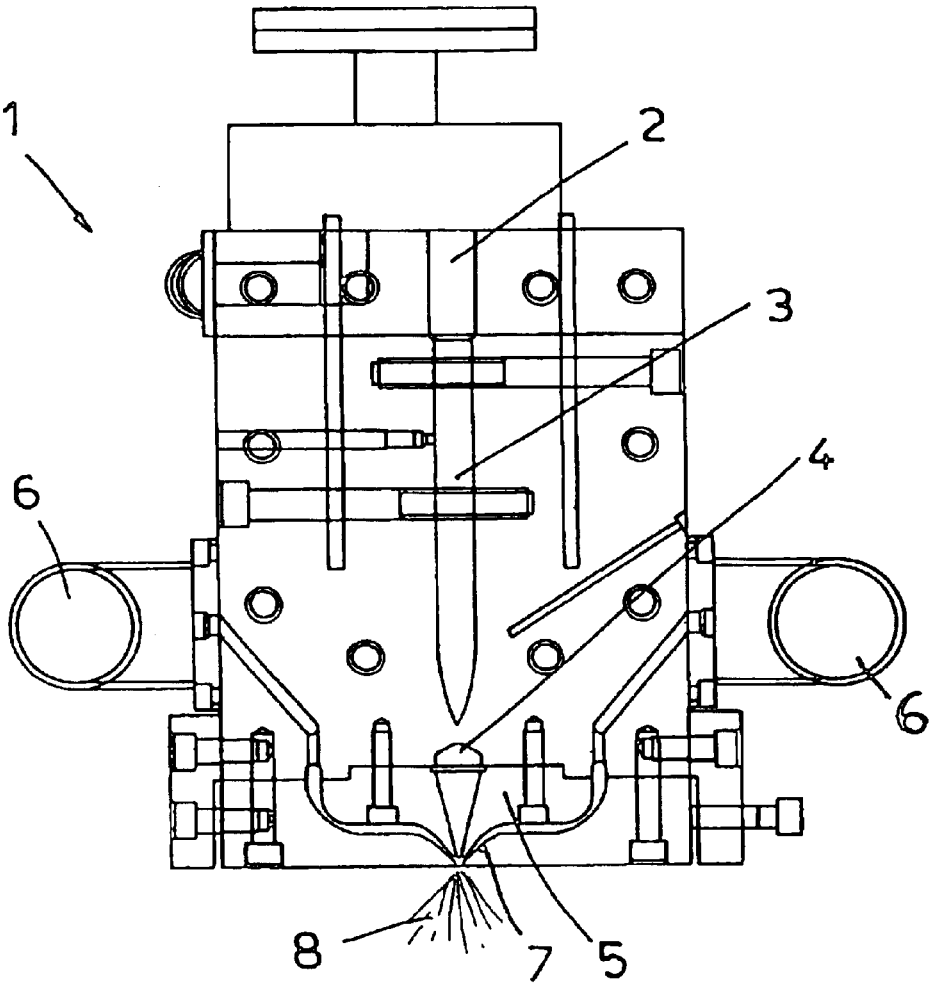
FIG.1 (PRIOR ART)
FIG. 1 is a cross-sectional view illustrating a prior melt-blowing head.

FIG. 1 schematically illustrates, at the reference number 1, a melt-blowing head of conventional type.

Such a prior melt-blowing head 1 comprises an inlet 2 for the polymeric material to be melt-blown, a polymeric material delivery or distributing channel 3, a filter 4, a melt-blowing die 5 as well as channels 6 for supplying hot air.

At the outlet of the holes 7 of the melt-blowing die 5, a plurality of fibrils 8 will be obtained by spraying.

Figure 2:
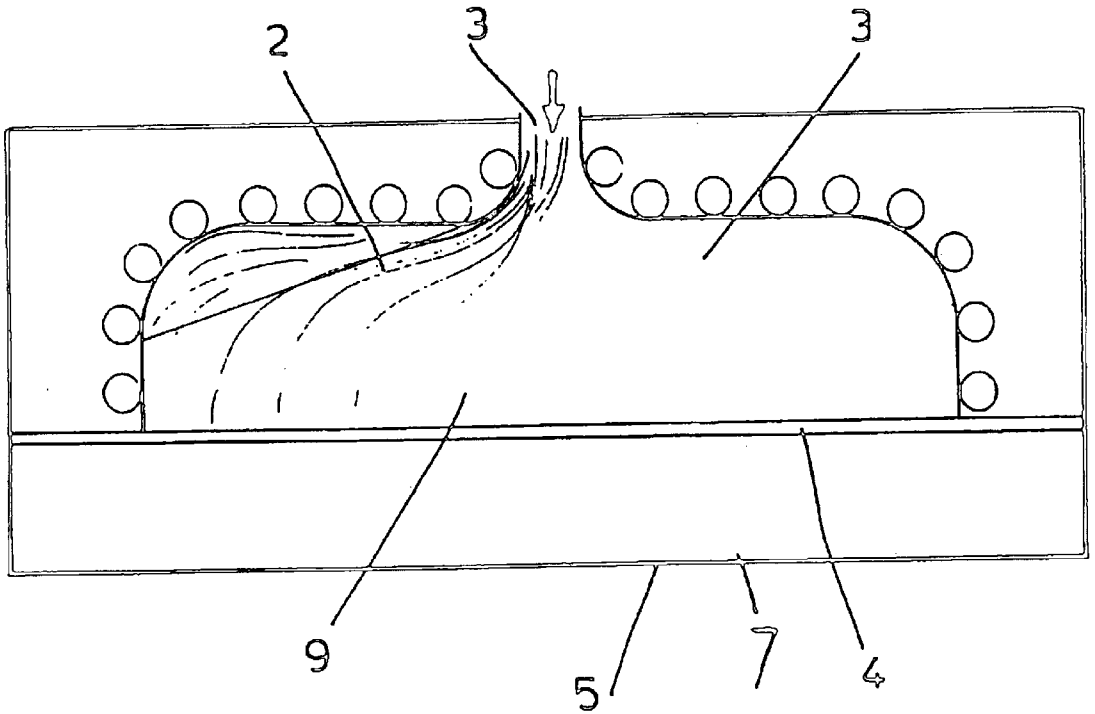
FIG. 2 (PRIOR ART)
FIG. 2 is a longitudinal cross-sectional view illustrating the melt-blowing head shown in FIG. 1.

As clearly shown in FIG. 2, the above mentioned polymeric material delivery channel 3 is widened in the form of a narrow chamber 9, in which the polymeric mass supplied to a pre-die or filter 4 and then to the die 5 is expanded.

Thus, the path of the polymeric material from the inlet 2 to the die holes 7 would be a random and uncontrolled path.

Then, it should be apparent that this lacking of properly controlling the supplying of the polymeric material from the inlet 2 to the die 5 holes 7 would generate variations in the flow of the polymeric material, due to the different holding time in which said polymeric material is held in the chamber 9.

Accordingly, the polymeric material will be subjected to an uncontrolled thermal processing, very different from that would be necessary and desired.

Moreover, the above mentioned different time and temperature would generate a degradation of the polymeric material, which will have a different melt index or fluidity, and a different flow rate through the melt-blowing die.

Thus, fibrils will be generated having different chemical-physical characteristics (for example length, cross-sections, consistency and so on, which would provide an end product (for example a non-woven fabric) with dishomogeneous properties (such as toughness, felting, thickness and so on).

Figure 3:
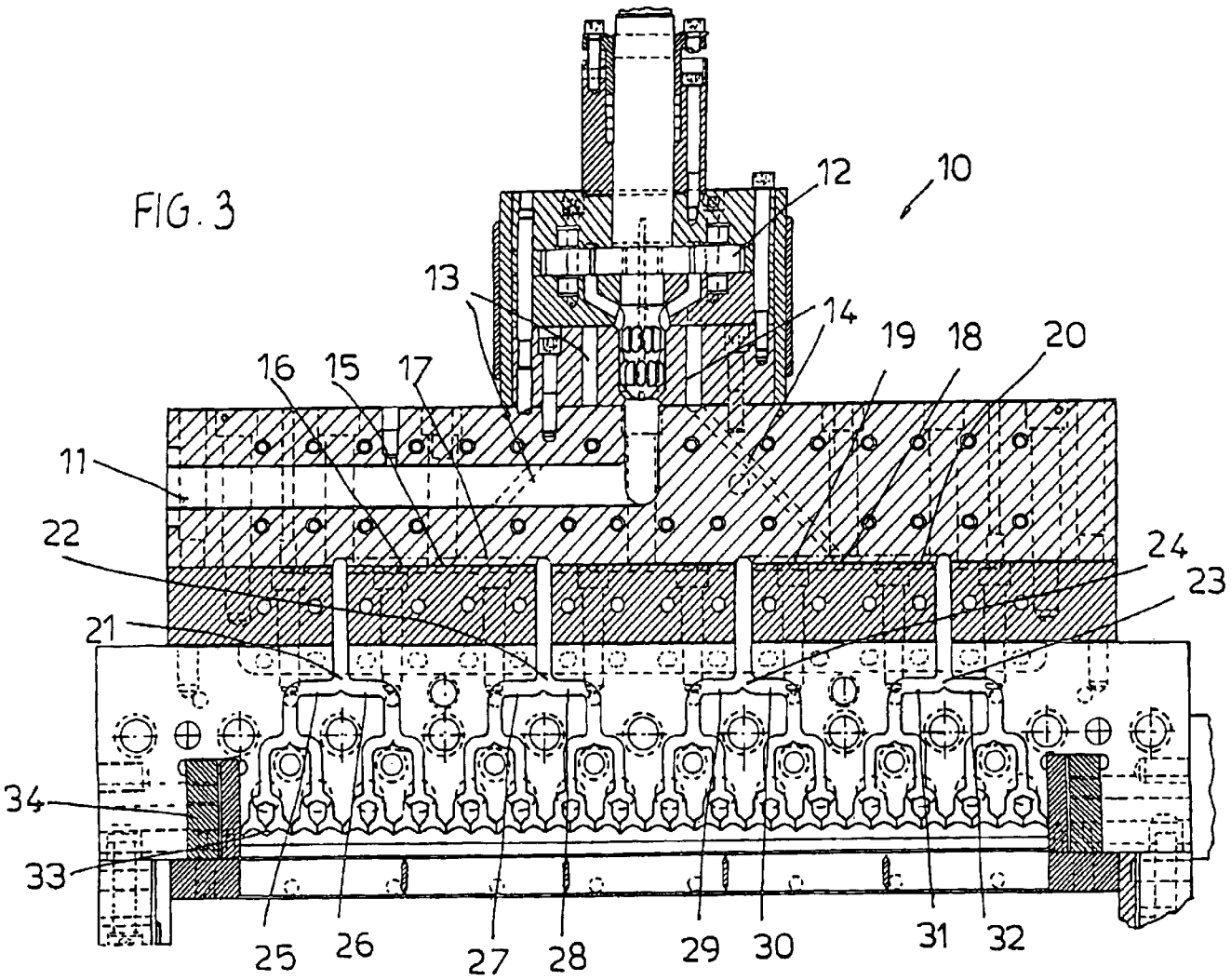
FIG. 3 is a cross-sectional view illustrating a melt-blowing head according to the present invention.
Figure 4:
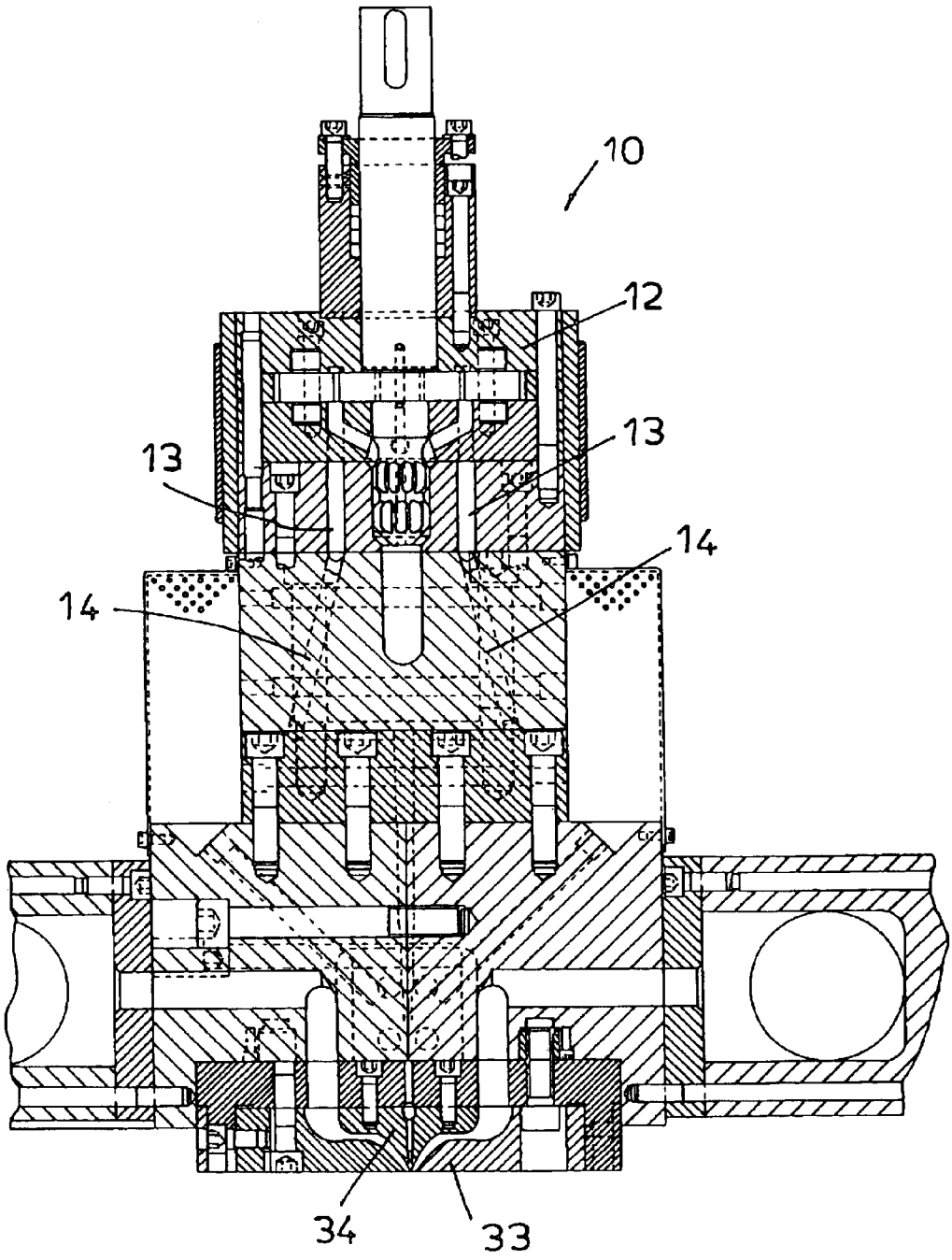
FIG. 4 is a further longitudinal cross-sectional view illustrating the melt-blowing head of FIG. 3.

The melt-blowing head according to the present invention has been indicated by the reference number 10 in FIGS. 3 and 4.

Said melt-blowing head comprises a polymeric material inlet channel 11, the polymeric material being supplied by a geared volumetric or displacement pump 12.

Said pump, in turn, will drive the polymeric material inside two main channels 13 and 14, having like shapes and size, from which extend the polymeric material delivering channel arrangement, having a tree construction which will be disclosed in a more detailed manner hereinafter.

At the end of the main arm 13 therethrough the polymeric material is supplied to the melt-blowing die, i.e. on the first knot 15 of the above mentioned tree construction, extend two secondary side arms or branches 16 and 17, whereas, at the end portion of the other main branch or arm 14, i.e. at the level of the knot 18 thereof corresponding to said knot 15, extend other two secondary side arms or branches 19 and 20, having the same shape and size as the mentioned branches or arms 16 and 17.

In particular, said branches 16, 17 and 19, 20 have, in the embodiment being illustrated, a substantially L-shape with the vertical leg downward directed, in the direction of the die 34 of the melt-blowing head 10.

On the respective end portions 21, 22, 23 and 24 of the above mentioned branches, forming middle branches or arms of the polymeric material delivery channel arrangement, are formed corresponding knots of the tree construction, therefrom respective secondary side branches 25,26; 27,28; 29,30 and 31,32 extend.

The above mentioned branches are equal to one another for shape and size and have the same L-shape extension as that of the branches 15, 17 and 19, 20, as above disclosed.

As shown, the polymeric material delivery channel extends, with a like tree construction, up to the holes 33 of the die 34 therefrom the fibrils are extruded.

Owing to the above disclosed polymeric material supply channel arrangement, for supplying the polymeric material to the melt-blowing die, to each of the n holes 33 of the die 34 will correspond a specifically designed path which, for shape and size, would be like to all the other path arrangements joining the polymeric material inlet channel 11 to other fibril extruding holes 33.

Owing to the above disclosed construction of the polymeric material delivery channels, the holding time in which the polymeric material is held in the path from the inlet 11 to the holes 33 will be the same for all the die holes, thereby providing a homogeneous distribution of said polymeric material inside said melt-blowing head.

Thus, the polymeric material at the outlet of the holes 33 will be provided with the same heat amount and driving energy or power, thereby allowing to make, at the outlet of the die 34, a plurality of fibrils having mutually homogeneous chemical and physical properties.

Figure 5:
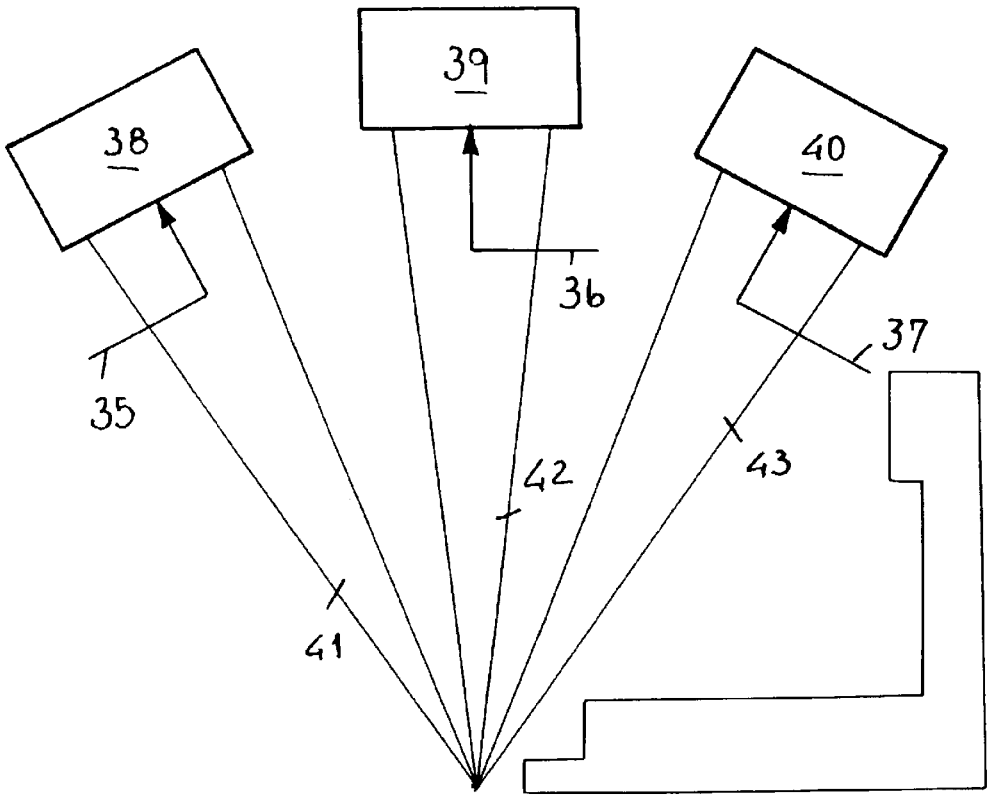
FIG. 5 illustrates a further modified embodiment of the melt-blowing head according to the present invention.

In the modified embodiment shown in FIG. 5, the melt-blowing head has three different inlets 35, 36 and 37 for corresponding polymeric materials, each of said inlets supplying respective geared volumetric or displacement pumps 38, 39 and 40.

Each of said pumps will in turn supply the corresponding polymeric material to a respective delivery channel 41, 42 and 43 having the tree construction disclosed with reference to FIG. 3.

Thus, the different polymeric material will arrive at the melt-blowing die according to insulated path arrangements, equal to one another, thereby they will exit the die in the form of multicomponent fibrils.

The invention, as above disclosed and illustrated, is susceptible to several modifications and variations without departing from the inventive scope; for example, the tree construction polymeric material delivery channel arrangements can be further properly modified in their geometric and configuration parameters.

What is claimed is:

1. A melt-blowing head for producing fibrils of a polymeric material in particular for making non-woven fabrics, said melt-blowing head comprising at least a polymeric material inlet channel and a melt-blowing die with a plurality of holes for extruding fibrils therefrom, said melt-blowing head further comprising geared displacement pump delivering said polymeric material to two main channels having like shapes and size from which extends a channel arrangement for distributing said polymeric material from said inlet channel to each said hole of said melt-blowing die, said channel arrangement comprising a tree construction extending from said polymeric material inlet channel and having a plurality of tree branches each of which ends at a respective hole of said die, one of said two main channels having an end portion defining a first knot of said channel arrangement, from said first knot extending two first side branches, the other of said main channels having an end portion defining a second knot therefrom extend other two second branches having the same L-shape and size of said two first side branches, said L-shape having a vertical leg downward, said first and second branches having respective end portions forming middle branches of said channel arrangement thereby forming further knots therefrom further secondary side branches extend having equal L-shape and size as those of said first and second branches, thereby to each said hole of said melt-blowing die will correspond a like extruding path connecting said polymeric inlet channel to each of said holes of said melt-blowing die, thereby said polymeric material is held in each said branch for an equal holding time.

* * * * *